US005330099A

United States Patent [19]

Beales et al.

[11] Patent Number: 5,330,099

[45] Date of Patent: Jul. 19, 1994

[54] CONTAINER FOR FOODSTUFFS

[75] Inventors: Jonathan T. Beales, Memphis, Tenn.; David E. Stier, Middletown, N.Y.

[73] Assignee: International Paper Company, Purchase, N.Y.

[21] Appl. No.: 131,520

[22] Filed: Oct. 4, 1993

Related U.S. Application Data

[63] Continuation-in-part of Ser. No. 48,176, Apr. 20, 1993, abandoned.

[51] Int. Cl.[5] ..... B65D 5/54

[52] U.S. Cl. ..... 229/207; 229/125.08; 229/160; 229/232; 229/906

[58] Field of Search ..... 229/125.08, 125.19, 229/160, 207, 229, 232, 902, 903, 906

[56] References Cited

U.S. PATENT DOCUMENTS

| | | | |
|---|---|---|---|
| 2,736,656 | 2/1956 | Marshall . | |
| 3,109,577 | 11/1963 | Knipp . | |
| 3,146,933 | 9/1964 | Moore . | |
| 3,368,738 | 2/1968 | Roccaforte . | |
| 3,526,353 | 9/1970 | Jaeschke . | |
| 3,877,630 | 4/1975 | Silver . | |
| 3,905,646 | 9/1975 | Brackmann et al. | 229/207 |
| 3,983,999 | 10/1976 | Morton . | |
| 4,043,503 | 8/1977 | Meyers et al. | 229/232 |
| 4,449,633 | 5/1984 | Johnson et al. | 229/207 |
| 4,687,104 | 8/1987 | Ielmini | 229/207 |
| 4,738,365 | 4/1988 | Prater | 229/207 |
| 4,813,594 | 3/1989 | Brown et al. | 229/906 |
| 4,836,438 | 6/1989 | Rigby . | |
| 4,836,439 | 6/1989 | Hart . | |
| 4,886,170 | 12/1989 | Willey . | |
| 4,915,292 | 4/1990 | Ielmini | 229/207 |
| 4,930,639 | 6/1990 | Rigby . | |
| 4,951,868 | 8/1990 | Mode . | |
| 4,966,296 | 10/1990 | Farrell . | |
| 5,012,929 | 5/1991 | Roosa | 229/207 |
| 5,078,273 | 1/1992 | Kuchenbecker | 229/207 |
| 5,085,323 | 2/1992 | Kuch | 229/207 |
| 5,105,950 | 4/1992 | Gottfreid et al. | 229/125.19 |
| 5,183,201 | 2/1993 | Gulliver . | |

FOREIGN PATENT DOCUMENTS

| | | | |
|---|---|---|---|
| 1129223 | 1/1957 | France | 229/232 |

*Primary Examiner*—Gary E. Elkins
*Attorney, Agent, or Firm*—Michael J. Doyle

[57] ABSTRACT

An eat-in paperboard container for frozen or refrigerated foodstuffs is provided with lateral flanges and triangular sections at its forward two corners. The package is opened by a tear strip which frees an edge of the top cover for lifting and access to the foodstuff. In use, the triangular sections rigidify the tray when the top cover is ripped up to open the container and when the consumer grasps one of the lateral flanges during eating out of the container.

10 Claims, 7 Drawing Sheets

CONTAINER FOR FOODSTUFFS

BACKGROUND OF THE INVENTION

This application is a Continuation In Part application of copending application Ser. No. 08/048,176 filed Apr. 20, 1993 by Jonathan T. Beales and David E. Stier and entitled CONTAINER FOR FOODSTUFFS, now abandoned.

This invention relates to containers and more particularly to paperboard containers for foodstuffs. Paperboard containers for holding refrigerated of frozen foodstuffs are known, typical examples being shown in U.S. Pat. No. 4,930,639 issued to Rigby and U.S. Pat. No. 4,886,170 issued to Willey. Such containers are often provided with a front cover flange which includes a tear strip, with the operation being such that when the tear strip is torn off, the edge of the cover flange is grasped for pulling it upwardly to obtain access to the carton interior. A fairly recent innovation refrigerated and frozen foodstuff paperboard containers is the provision of one or more outwardly extending panels or flanges to facilitate the removal of the container from an oven by grasping such a panel or flange. However, the construction of such containers is not entirely satisfactory due to bending and warping of one or both of the finger grasping flanges when held to steady the container while consuming its contents.

SUMMARY OF THE INVENTION

According to the practice of this invention each of two laterally extending, horizontal flanges running along the sides of the container is reinforced by a novel top cover panel configuration. The top cover panel includes a downwardly extending front flange which covers the front wall of the tray of the container. This front flange is so configured as to provide a reinforcing web to inhibit bending or warping of the horizontal flanges. Further, the top cover is so configured that upon ripping it open a portion of it remains sealed to the lower tray of the container to inhibit bending of the container during ripping up of the top cover panel.

DETAILED DESCRIPTION OF THE INVENTION

Figure 1:
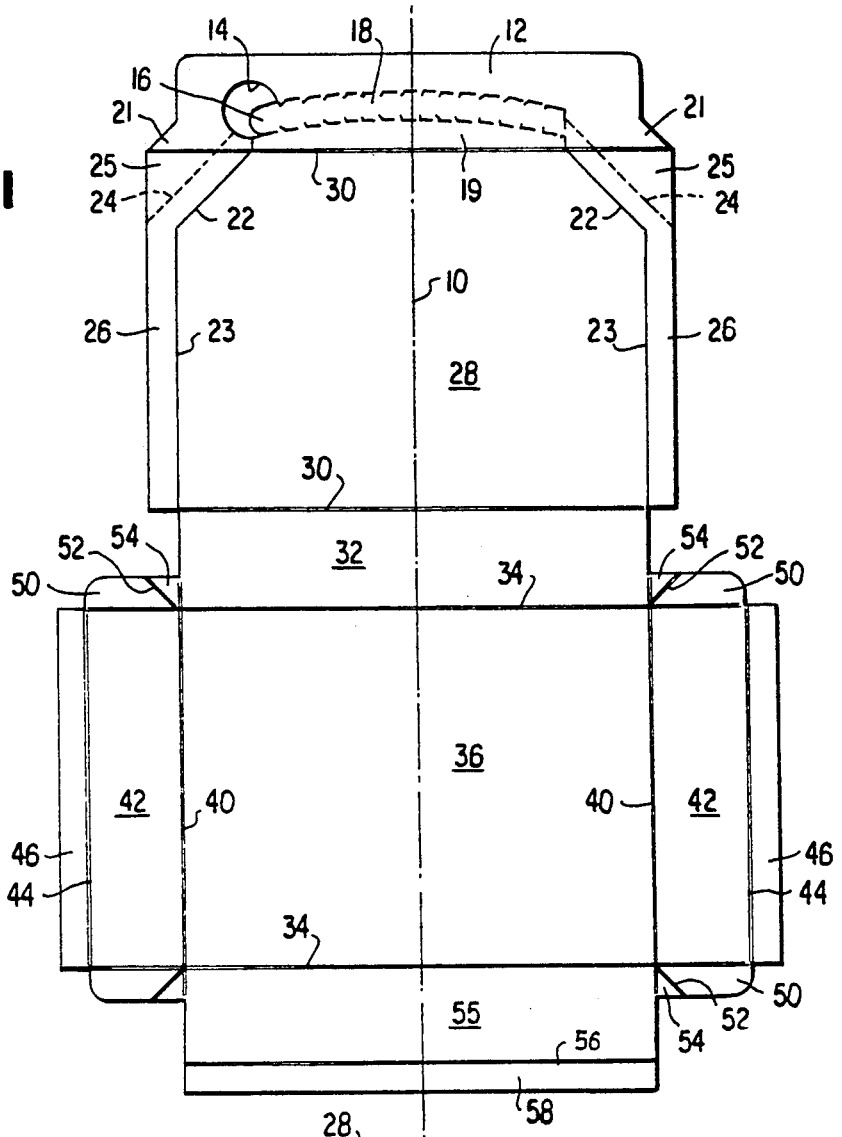
FIG. 1 is a plan view of a unitary blank for forming the container of this invention, according to a first embodiment.

Referring now to FIG. 1 of the drawings, a unitary paperboard blank is denoted as 8, the blank typically coated on both sides with one or more barrier layers such as polyethylene, either singly or in combination with other polymer/barrier layers, such layers being conventional. The blank is typically die cut from indefinite lengths of coated paperboard. A vertical axis, bisecting the blank is designated as 10. A front cover panel 12 is provided with an opening 14 into which extends a manually graspable end 16 of a conventional tear strip 18. The area of flange 12 immediately below the tear strip is designated as 19. Generally triangular reinforcing webs, at the base of flange 12 as viewed at FIG. 1, are each designated as 21. The upper portion or zone of panel 12 is not as wide as the lower zone, the latter having triangular portions 21. Slanted cut lines 22 extend from the interior forming surface of the blank (facing the reader) approximately halfway through the paperboard towards the often blank surface. Second cut lines 24, generally parallel to cut lines 22, extend from the rear surface of the blank (away from the reader) towards the reader approximately halfway through the thickness of the paperboard. Cuts 24 define triangular segments 25. The lower termini of cut lines 22 join with the upper ends of vertical cut lines 23, also cut approximately half way through the thickness of the paperboard, similar to cut lines 22. Laterally extending flanges 26 extend away from cut lines 23 on both sides of blank 8.

A rear tray wall forming panel 32 is provided at its lower portion with a score line 34, at its upper portion with score line 30, with panel 32 joining top cover panel 28 to bottom forming panel 36. Left and right edges of bottom panel 36 are defined by score lines 40, the latter joining side wall forming panels 42 to bottom panel 36. The outer lateral edge of each of side wall forming panels 42 is provided with a score line 44 which joins horizontal flange panels 46 to respective side wall panels 42. External fold gussets 50 are integrally joined both to the right and left edges of panels 32 and 55 and to the upper and lower edges of panels 42. Each panel 50 is provided with a slanted score line 52 to define a triangular portion 54.

Tray front wall panel 55 is provided at its lower end with a score line 56, which joins horizontal flange 58 to front panel 54. It will be observed that, with the exception of opening 14 and tip 16 of tear strip 18, that blank 8 is mirror symmetrical about axis 10.

Figure 2:
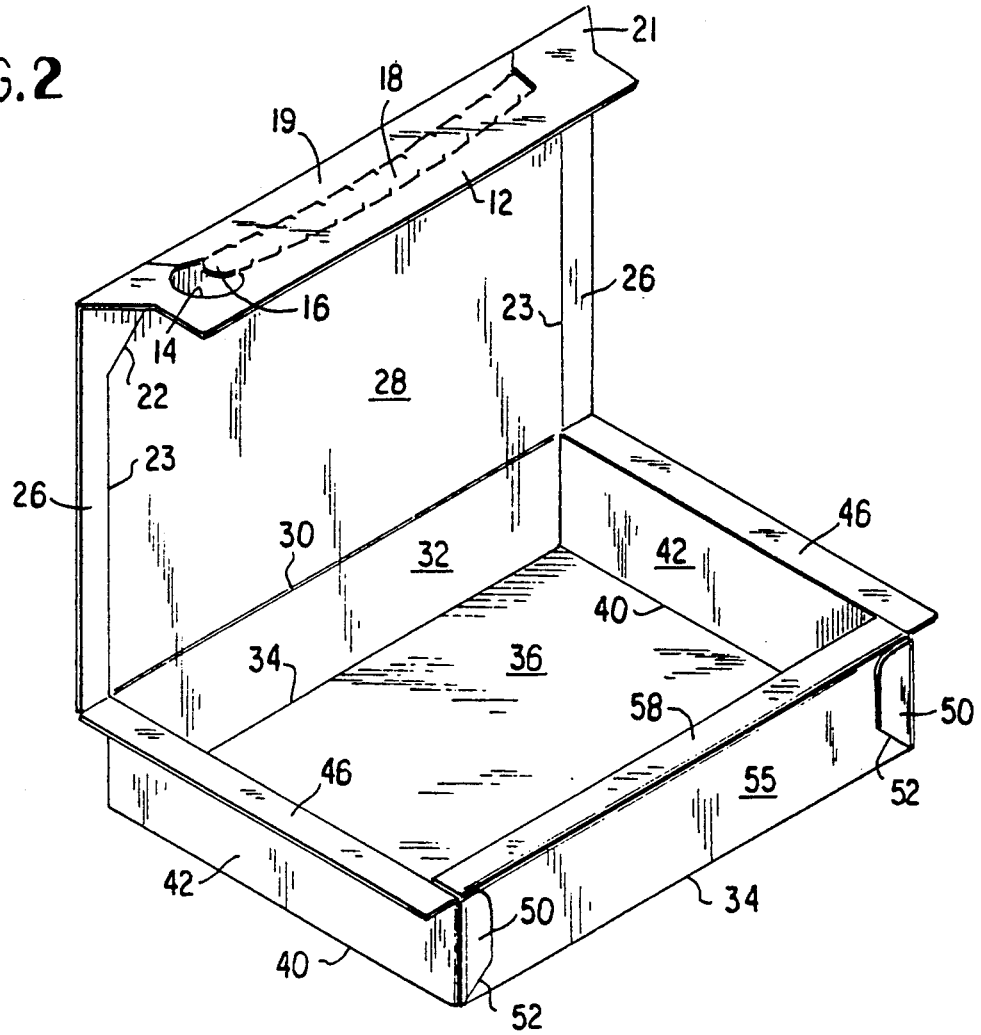
FIG. 2 is a perspective view showing the container formed from the blank of FIG. 1 and prior to the packaging of a foodstuff therein.
Figure 3:
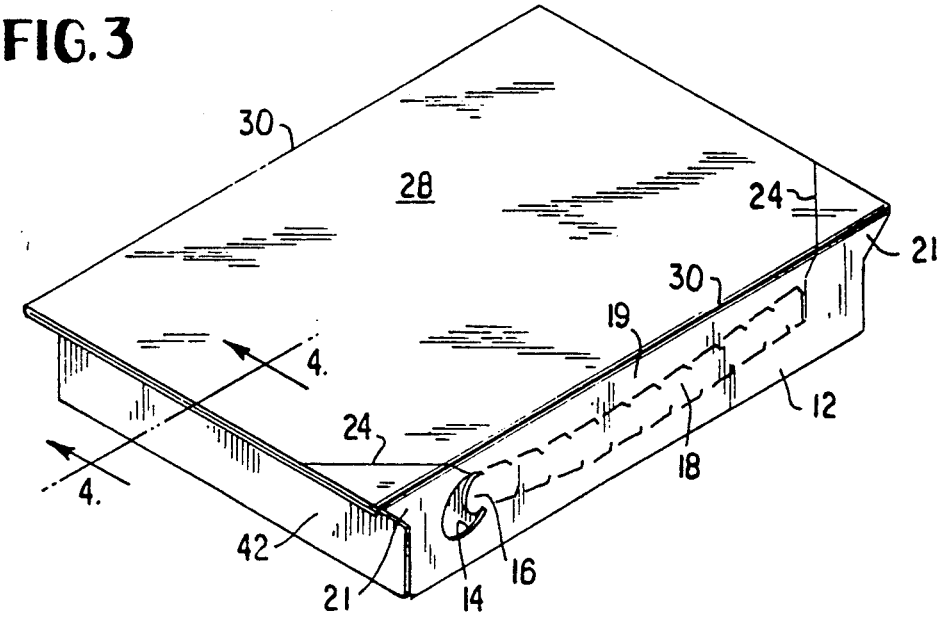
FIG. 3 is a view showing the container of FIG. 2 in the closed position after it has been filled with a foodstuff.

Referring now to FIG. 2 of the drawings, the blank of FIG. 1 has been erected and glued to form a container defined by a tray having an integral rear cover. External gusset panels 50 are folded over themselves about respective fold lines 52 and adhesively secured to the front and rear walls 55 and 32, respectively, of the tray. Horizontal flanges 46 extend laterally outwardly and are substantially perpendicular to side walls 42 from which they extend, with front horizontal flange 58 extending inwardly of the tray. The tray is now ready for appropriate sterilization and foodstuff filling operations and is then closed. Except for tear strip 18 and zone 19 of front cover flange 12, all portions of the front flange are provided with food grade adhesive to seal and close the container to the configuration of FIG. 3. Similarly, adhesive is placed between horizontal flanges 46 and flanges 26 of lid or cover 28. In practice, the thermoplastic coating(s) on the paperboard may be heated and then joined, instead of with an adhesive.

Figure 4:
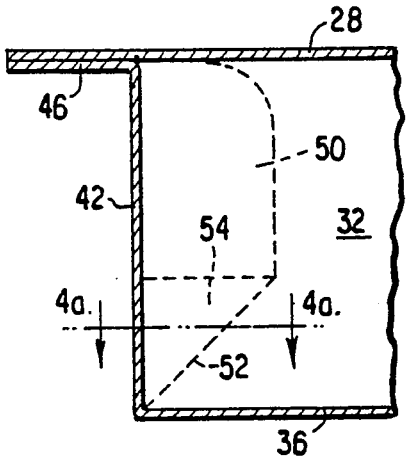
FIG. 4 is a view taken along section 4—4 of FIG. 3.
Figure 4A:
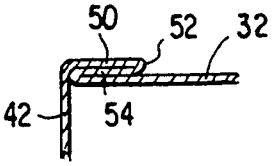
FIG. 4*a* is taken along section 4*a*–4*a* of FIG. 4.

FIGS. 4 and 4*a* show the overlapping of each external gusset 50.

Figure 5:
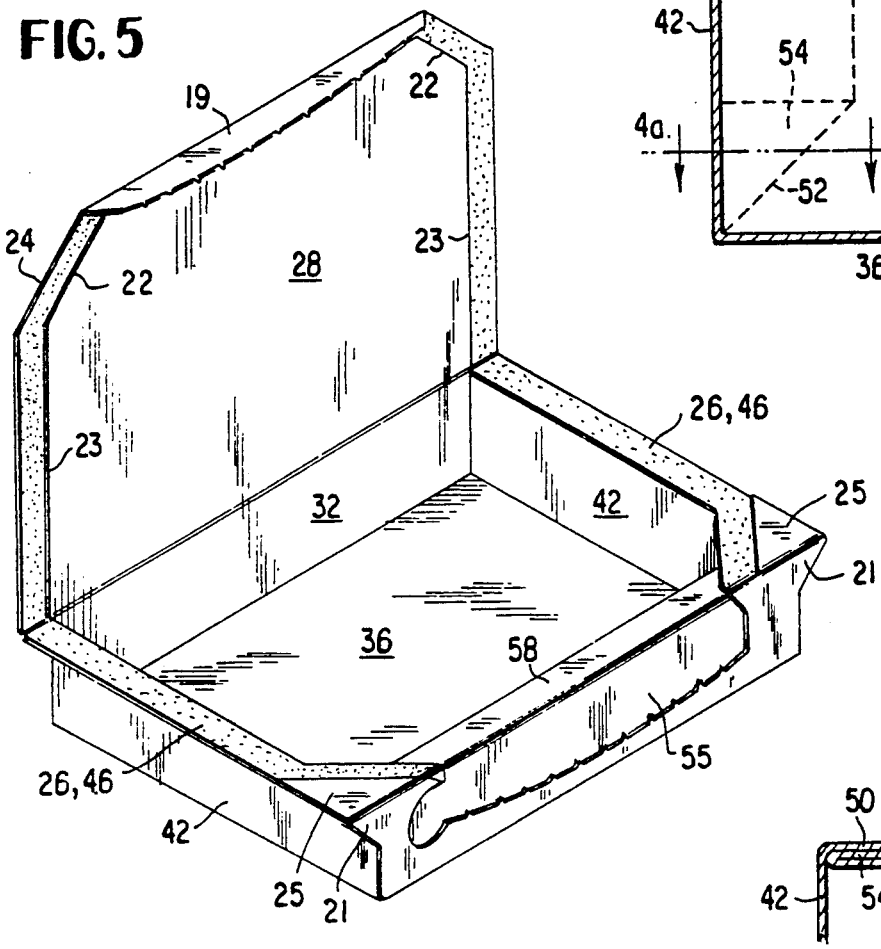
FIG. 5 is a view showing the configuration of the container of FIG. 3 after it has been opened.

FIG. 5 illustrates the container after it has been opened, with the food contents not being shown, for purposes of clarity. The user grasps tip 16 and pulls tear strip 18 away. Then the lower edge of zone 19 is manually lifted up to rip the peripheral portions 26 and the space between cut lines 22 and 24 midway through the thickness of cover 28. Thus, a portion of the periphery of the cover (flanges 26) remains on flanges 46 of the tray. This general type of ripping, due to so called reverse cuts, is known. FIG. 5 shows triangular sections at the container forward ends, with triangular segments 21 of lid flange 12 still secured to triangular portions 25 of the top cover, to thereby enhance tray rigidity. Such rigidity is important for an eat-in food container, since the container is used for both storage prior to use and as a dish or bowl during use. Thus, if the consumer desires to grasp one of the side flanges 26, 46 to sturdy it while eating from it, additional rigidity afforded by triangular segments 25 and 21 is significant.

Figure 6:
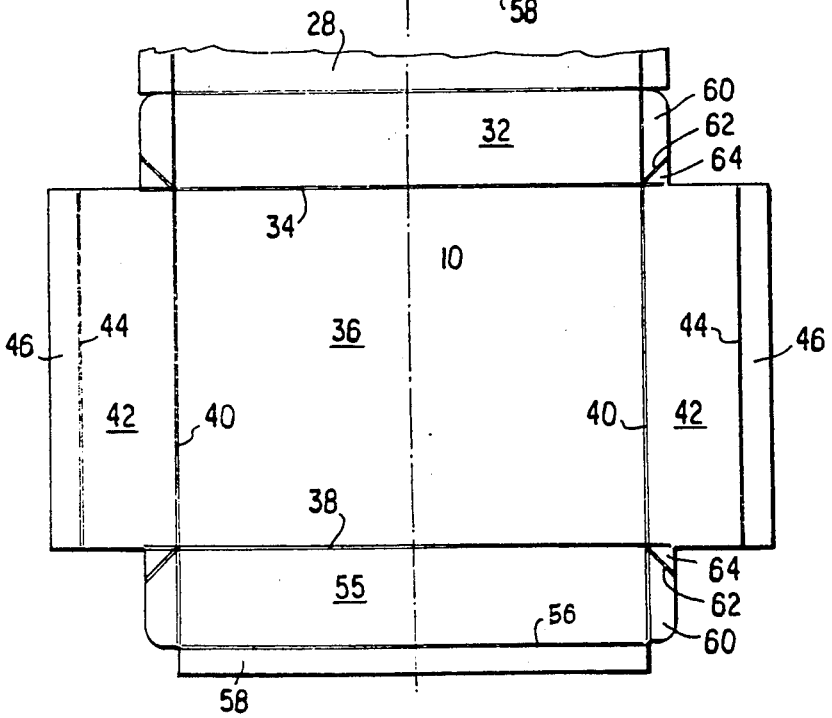
FIG. 6 is a view similar to FIG. 1 and illustrates a modification of the tray forming portion of the blank of FIG. 1.
Figure 7:
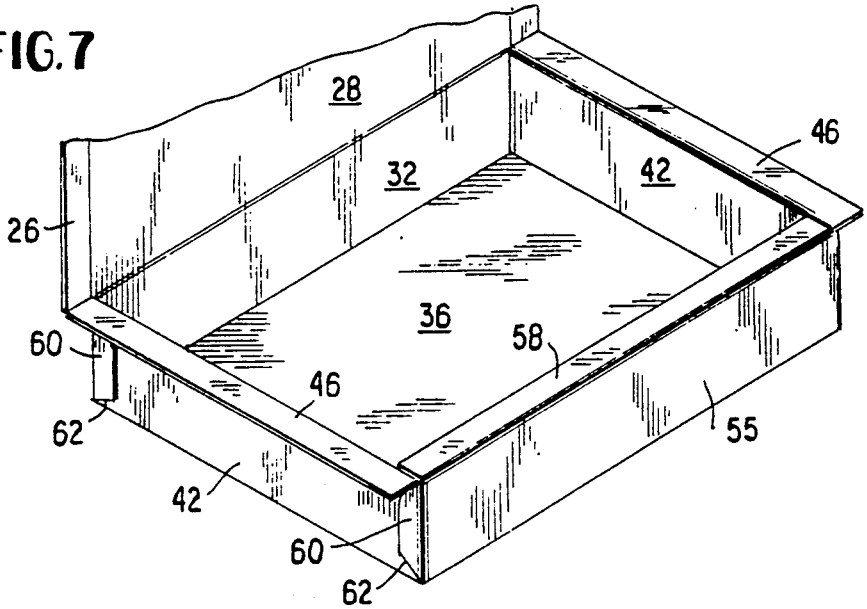
FIG. 7 is a view similar to FIG. 2 and illustrates the tray configuration formed with the modification of FIG. 6.

Referring now to FIG. 6 of the drawings, a blank similar to the lower part of blank 8 of FIG. 1 is shown, with the upper part of the blank of FIG. 6 being the same as the upper part of the blank of FIG. 1. However, the tray forming panels differ in that the external gussets, here designated as 60, extend along the full width of rear tray panel 34, instead of extending along the entire width of side wall forming panels 42, as do external gussets 50 in the blank of FIG. 1. After erection and gluing, it is seen at FIG. 7 that external gussets 60 are now folded against and are adhesively secured to each other and to side walls 42 instead of to the front and rear tray walls.

Figure 8:
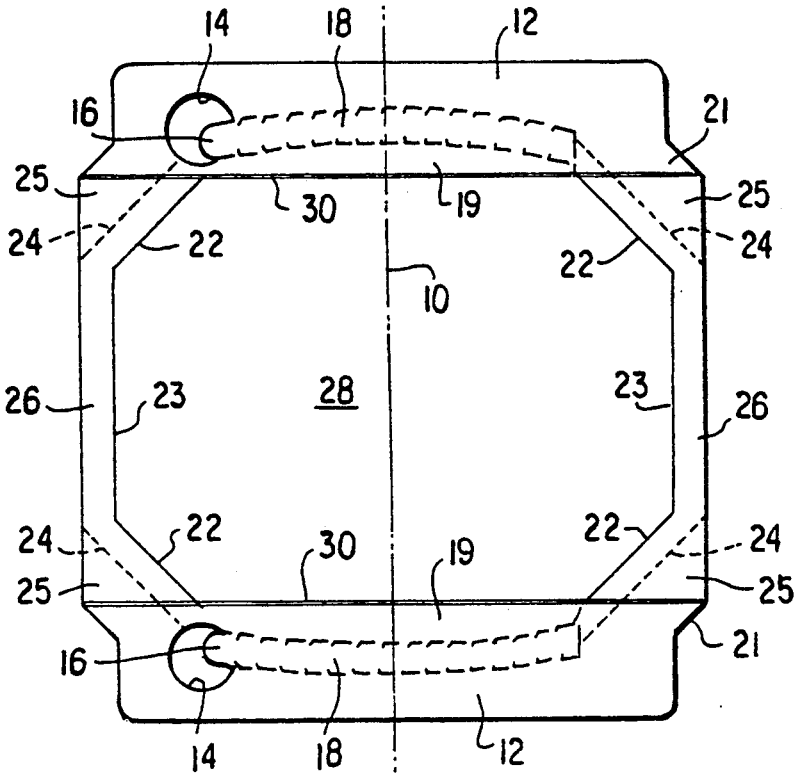
FIG. 8 is a plan view of a unitary paperboard blank for forming the top cover, according to a second embodiment.

Another embodiment is shown at FIGS. 8–11. FIG. 8 shows an alternative form of cover for the tray, also formed of paperboard. The cover is here provided with two downwardly extending cover panels 12, instead of a single cover panel 12 as in the embodiment of FIG. 1. The reader will observe that the top and bottom of the cover blank of FIG. 8 are mirror images of the each other, as referred to a horizontal axis bisecting the blank, and are identical to the top portion of the cover 28 of FIG. 1.

Figure 9:
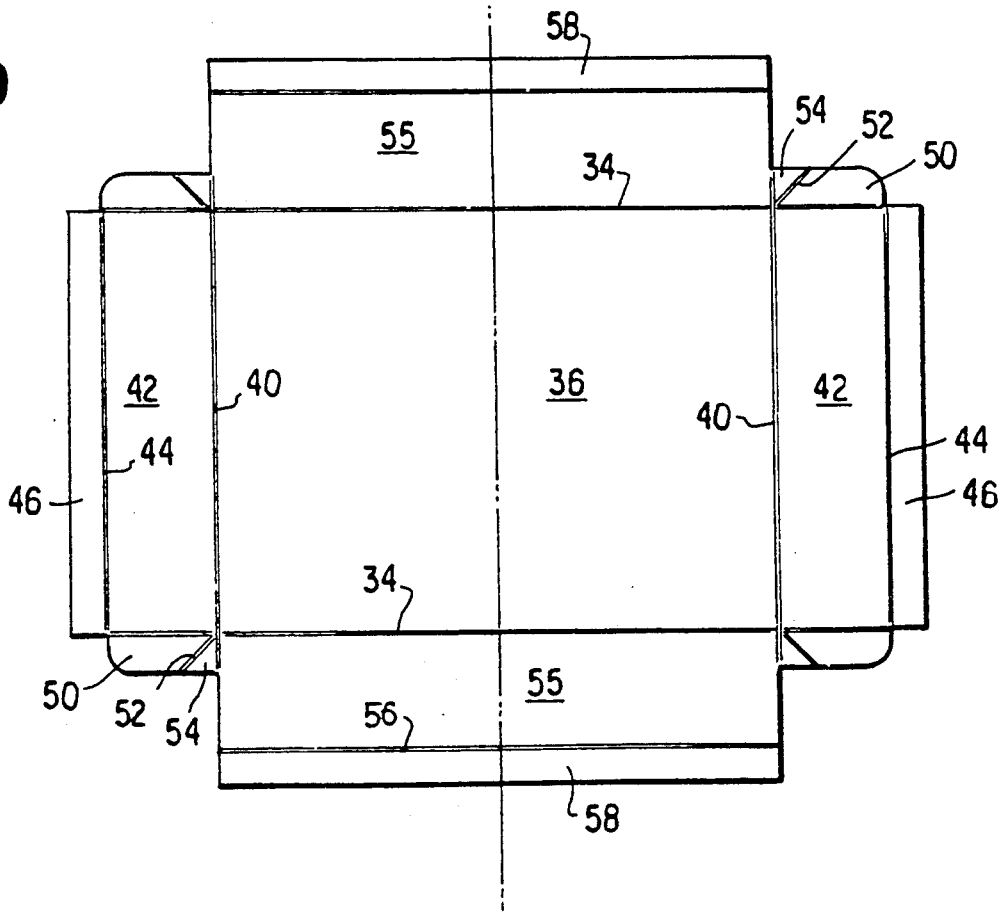
FIG. 9 is a plan view of a unitary paperboard blank for forming a lower tray for the cover of FIG. 8.

FIG. 9 illustrates a unitary paperboard blank for forming a tray for use with the cover of FIG. 8. The same reference numerals are employed at FIG. 9 as employed at FIG. 1 and designate corresponding elements.

Figure 10:
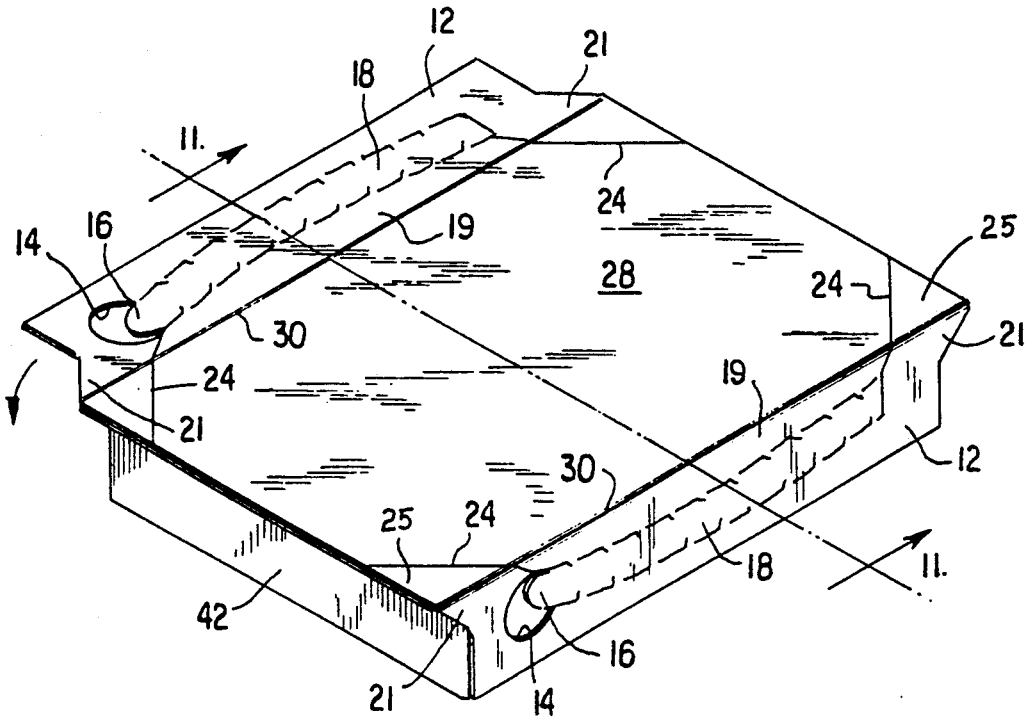
FIG. 10 is a perspective view of the assembled cover and tray formed from the blanks of FIGS. 8 and 9.

Referring now to FIG. 10, the blank of FIG. 9 has been erected and glued to form a tray having upstanding side, rear and front walls, and cover panels 12 are glued to respective front and rear walls 55 in the same manner as previously described. FIG. 10 shows the rear cover panel 12 about to be rotated for gluing, in the direction shown by the curved arrow.

Figure 11:
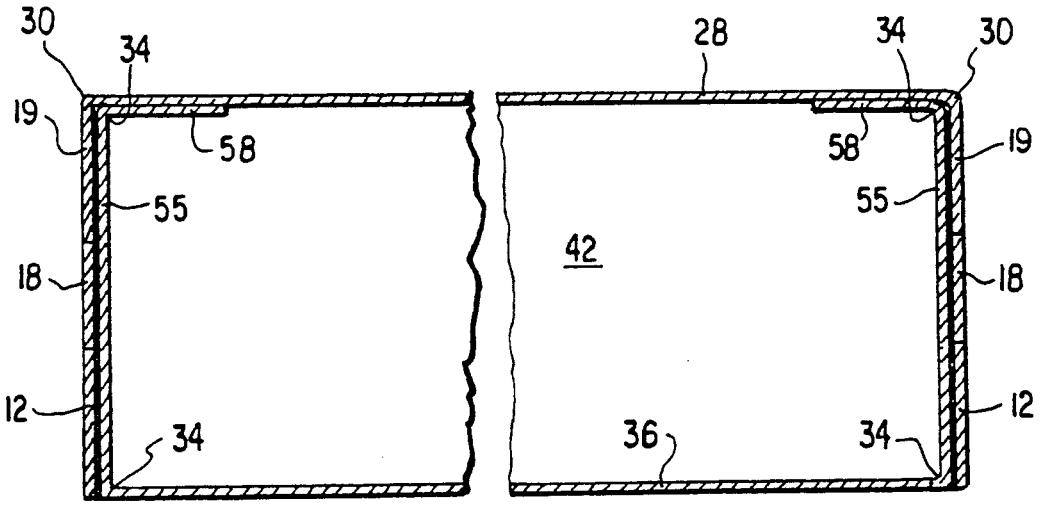
FIG. 11 is taken along section 11—11 of FIG. 10.

FIG. 11 illustrates the several panel elements after complete closure of the container of FIG. 10. The manner of use of the container illustrated in FIG. 10 is the same as that previously described. Further, the user may rip either tear strip 18 and lift the ripped edge of a corresponding zone 19 to gain access to the foodstuff in the tray.

Figure 12:
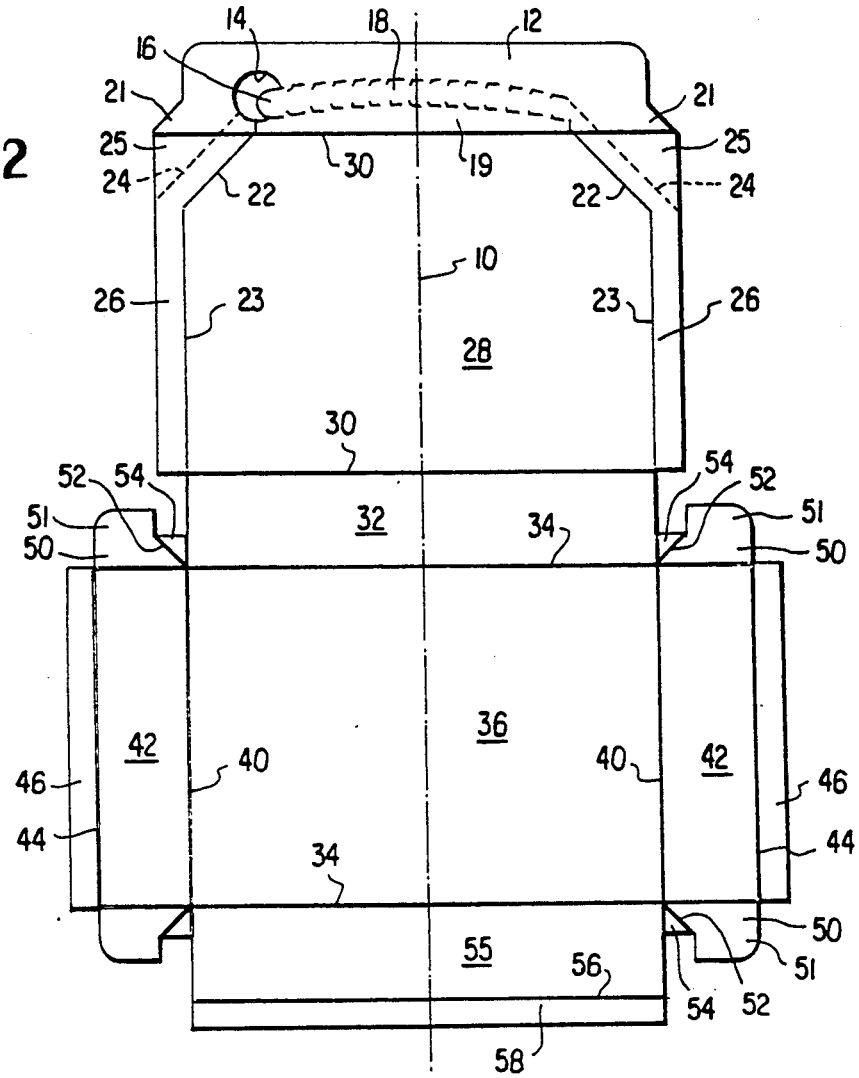
FIG. 12 is a view similar to FIG. 1 and illustrates a modification of the gussets.

Referring now to FIG. 12 of the drawings a modification of the gusset portions 50 is illustrated. Each gusset panel portion 50 is provided with an integral extension or tab 51.

Figure 13:
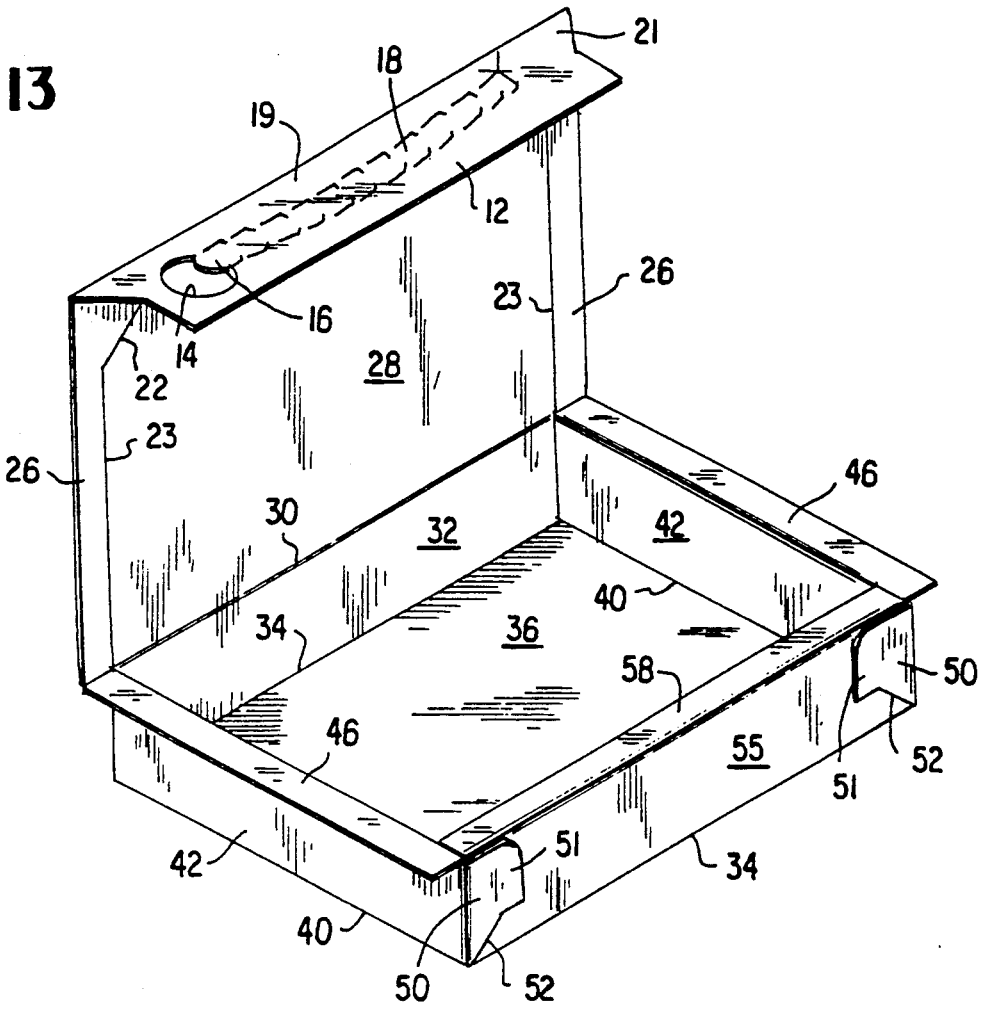
FIG. 13 is a view similar to FIG. 2 and illustrates a tray having the gusset modification of FIG. 12.

Referring now to FIG. 13, the action of tabs 51 is illustrated. It is seen that tabs 51 extend along front wall 55 and, not illustrated, also extend along rear wall 32. Tabs 51 provide additional adhesive or bonding area to affix the gussets to the tray front and rear walls.

Figure 14:
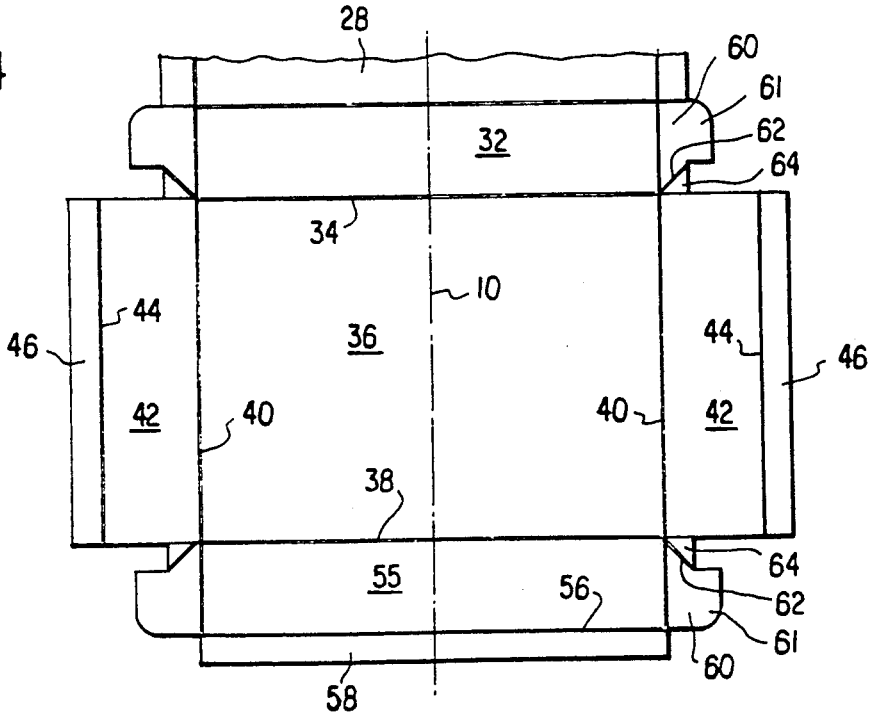
FIG. 14 is a view similar to FIG. 6 and illustrates another modification of the gussets.
Figure 15:
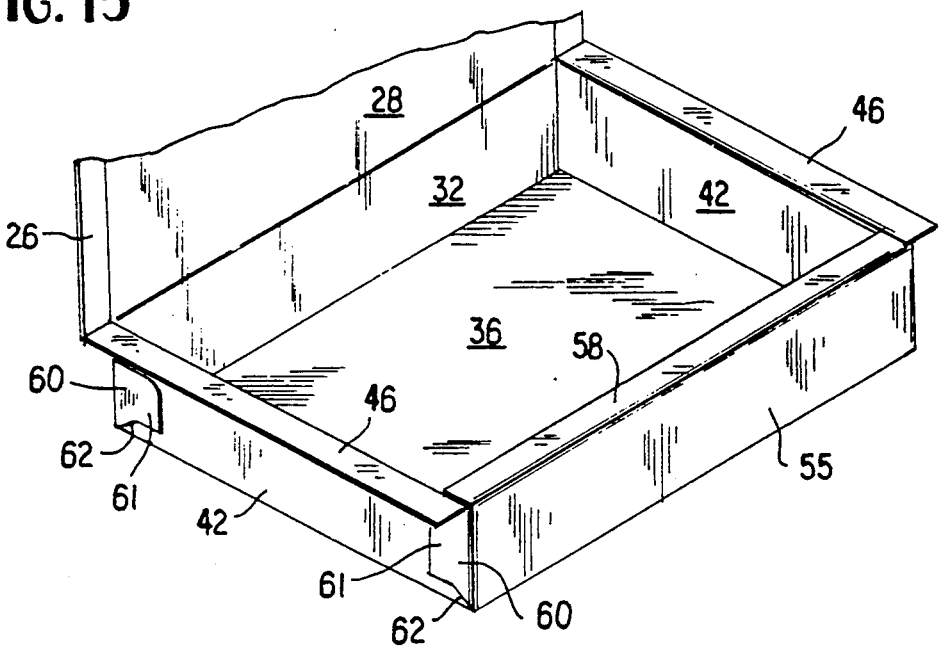
FIG. 15 is a view similar to FIG. 7 and illustrates a tray having the gusset modification of FIG. 14.

Referring now FIG. 14, integral extensions or tabs 61 are added to gussets portions 60. FIG. 15 illustrates gusset portions 60 and their respective tabs 61 bonded or adhered to side walls 42 to increase the bonding area of the gussets to the container side walls. It will be apparent that the gusset modifications of FIG. 12 and 14 may be employed with the blank of FIG. 9. Extensions or tabs 51 and 61 are known in this art.

Geometrical terms of orientation, such as vertical and the like, are employed to facilitate the description and are not intended to be terms of limitation.

We claim:

1. A paperboard container of generally rectangular parallelepiped form and displaying particular utility for the packaging of frozen foodstuffs, the container including a lower tray and an upper cover panel which covers said tray, said tray having a bottom wall, two side walls, a rear wall, and a front wall, said side walls and said front wall each having an upper edge, said front wall, said rear wall, and said side walls each having ends, a horizontal flange extending laterally outwardly from said upper edge of each said side walls, a horizontal flange extending inwardly from said upper edge of said front wall, an external gusset integrally joining adjacent said ends of each of said side walls, front wall, and rear wall to thereby define four external fold gussets, each of said external gussets being at least partially folded upon itself along a fold line extending across itself, said upper cover panel extending over and covering said tray and adhesively secured to said side wall horizontal flanges, said upper cover panel having a front flange and an elongated tear strip therein, said front flange having ends and being of a length substantially the same as the length of said tray front wall except for generally triangular web portions at respective said front flange ends adjacent the juncture of said upper cover panel and to said upper cover panel front flange, said upper cover front flange adhesively secured to said tray front wall except at said tear strip and except at a region of said upper cover front flange which is located above said tear strip, a slanting exterior cut line at a front edge of said upper cover panel to define a triangular segment of each said front edge of said upper cover panel, slanting interior cut lines which parallel respective said slanting exterior cut lines, and main lateral cut lines running parallel to said outwardly extending side wall horizontal flange, all of said cut lines extending approximately one half through the thickness of said upper cover panel.

2. The container of claim 1 wherein the major portion of each said folded external gusset extends from a said side wall and is folded against and adhesively secured to a corresponding said front or said rear wall, from a said front or rear wall and folded against and adhesively secured to a corresponding said side wall.

3. The container of claim 1 wherein the major portion of each said folded external gusset extends from a said front or said rear wall and is folded against and adhesively secured to a corresponding said side wall.

4. The container of claim 1 wherein said tray and said upper cover panel are formed from a unitary blank.

5. The container of claim 1 wherein said upper cover panel is provided with a second said cover flange of a construction identical to said first recited front flange, said cover panel flanges being opposite to each other.

6. A unitary paperboard blank for forming an eat-in container, said blank having first and second surfaces, said blank including a front cover panel hinged by a score line to a top cover panel, said top cover panel hinged by a score line to a rear wall panel, the latter hinged by a score line to a bottom panel, the latter hinged by a score line to a front wall panel, said panels being vertically aligned and in series, a generally horizontal tear strip in said front cover panel, said tear strip having ends, a first pair of parallel, vertically running cut lines on said first surface of said cover panel and extending approximately one half through said paperboard, upper respective ends of said parallel cut lines terminating in a second pair of cut lines, said second pair of cut lines located on said first surface and extending approximately half way through said paperboard, said second pair of cut lines slanting towards each other and extending at least to said hinge between said top cover panel and said front cover panel, a third pair of cut lines parallel to said second pair of cut lines, said third pair of cut lines extending approximately half way through said paperboard on said second surface of said blank said second and third pair of parallel cut lines having upper termini, said upper termini located contiguous to said ends of said tear strip, whereby said third pair of cut lines define two respective triangular sectors at upper ends of said top cover panel.

7. The blank of claim 6 wherein said front cover panel has upper and lower zones, said lower zone being wider than said upper zone, said upper and lower zones each having left and right ends, said lower zone ends being slanted and merging with sections of said top cover at a region along said score line between said front cover panel and said top cover panel.

8. A blank of paperboard for forming a top cover for a tray, said blank being generally rectangular and having a rectangular central panel, said rectangular central panel having corners, said central panel having cover flaps hinged by respective score lines to respective upper and lower edges of said central panel, each said cover flap having a generally horizontal tear strip therein, each said tear strip having ends, a first set of four slanted cut lines at said corners of said rectangular central panel, a first set of two parallel cut lines joining respective ends of upper and lower respective pairs of said first set of four cut lines, portions of said score lines respectively joining other ends of said second set of four cut lines, all of said cut lines extending from one surface of the blank half way through the blank, a second set of four cut lines each of which is parallel to respective ones of said first set of four cut lines and cut half way through said blank from another blank surface, one set of ends of said second set of four cut lines terminating at respective edges of said blank, other ends of said second set of four cut lines terminating contiguously to respective said ends of said tear strips.

9. The container of claim 2 wherein said major portion of each said folded gusset is provided with an integral, coplanar extension.

10. The container of claim 3 wherein said major portion of each said folded gusset is provided with an integral, coplanar extension.

* * * * *